United States Patent [19]

Abbott

[11] Patent Number: 4,469,358

[45] Date of Patent: Sep. 4, 1984

[54] CHILD PROOF SECURITY DEVICE

[75] Inventor: Phillip G. Abbott, Rockford, Tenn.

[73] Assignee: Terry E. Henley, Knoxville, Tenn.

[21] Appl. No.: 370,378

[22] Filed: Apr. 21, 1982

[51] Int. Cl.[3] ..... E05C 7/02

[52] U.S. Cl. ..... 292/288; 292/DIG. 65

[58] Field of Search ..... 292/259, 264, 288, 258, 292/DIG. 65; 248/206 R, 206.3, 205.6, 206.2

[56] References Cited

U.S. PATENT DOCUMENTS

| | | | |
|---|---|---|---|
| 1,002,013 | 8/1911 | Urbon | 292/288 |
| 2,608,711 | 9/1952 | Moore | 292/288 X |
| 3,059,952 | 10/1962 | Wittman et al. | 292/264 X |
| 4,186,958 | 2/1980 | Welch | 292/264 X |

FOREIGN PATENT DOCUMENTS

| | | | |
|---|---|---|---|
| 950602 | 3/1949 | France | 248/206.3 |
| 625223 | 6/1949 | United Kingdom | 248/206.3 |

*Primary Examiner*—Richard E. Moore

*Attorney, Agent, or Firm*—Pitts, Ruderman & Kesterson

[57] ABSTRACT

Security devices for a toilet bowl and refrigerator are disclosed which are designed for preventing small children from independently gaining access to the contents of the toilet bowl or the contents of a refrigerator. The toilet bowl security device (10) includes first and further suction cup members (46) and (54) fabricated from flexible air impervious material. One of such suction cup members has a face area less than the face area of the further suction cup member such that the adhesive forces of the face having the greater area are greater thereby enabling the installer to determine which surface the device adheres to at all times. These suction cup members are joined by a stem (38) and as necessary or desired may be integrally formed therewith. In the device (70) for securing a refrigerator door (72), means (86) are provided for selectively joining first and further suction cup members 78 and 82 which are secured on the cabinet portion of the refrigerator and the door (72) respectively. An adult user can readily remove the means for selectively joining the suction cups to gain access to the contents of the refrigerator while a child is unable to overcome the adhesive forces of the suction members.

1 Claim, 10 Drawing Figures

CHILD PROOF SECURITY DEVICE

DESCRIPTION

1. Technical Field

This invention relates to security devices and is more specifically directed to a security device for preventing a small child from independently gaining access to the water and bowl area of a conventional bathroom toilet. In a further embodiment, a security device is provided to prevent a small child from gaining access into the contents of a refrigerator by securing the door in its closed position by forces which can readily be overcome by an adult.

2. Background Art

Small children, particularly children who are walking yet less than about three to three and onehalf years old are attracted by the water contained in the bowl portion of a conventional toilet. Such children like to raise the lid portion of the toilet and stick their hand into the toilet for purposes of drinking or to splash water. Various types of devices have heretofore been known to assist in securing the seat and lid portion of the toilet in a closed position. Examples of such known prior art are disclosed in U.S. Pat. Nos. 723,973; 2,404,124; and 2,431,263. These devices illustrate various types of apparatuses which can be used to secure the lid of a toilet in a closed position and to assist in preventing a child from gaining access to the water contained in the bowl area.

Certain of the known prior art devices are inexpensive to manufacture and difficult to install. Moreover, certain of such devices require a significant effort to release the lid portion of the toilet in order to place the toilet in condition for use. Contrawise, the present invention is directed to a toilet security device which can be readily installed, and a similar security device is designed for securing the door of a conventional refrigerator such that a small child cannot independently gain access into the refrigerator contents. In each of the illustrated devices, an adult can readily overcome the forces which maintain the devices in the secured position.

Accordingly, it is an object of the present invention to provide a security device for preventing a small child from independently gaining access to the water and bowl area of a conventional bathroom toilet.

Another object of the invention is to provide a security device for preventing a small child from independently gaining access into the contents of a conventional refrigerator.

Yet another object of the present invention is to provide security devices which can be inexpensively manufactured and readily installed by an adult. Yet another object of the present invention is to provide a toilet bowl security device which is not accessible or exposed when the device is in use such that the child cannot tamper with the device and overcome its effectiveness. Still a further object of the present invention is to provide a refrigerator security device which can be positioned out of reach of a small child and which can be readily installed or disengaged by an adult designed to gain access into the contents of the refrigerator.

DISCLOSURE OF THE INVENTION

Other objects and advantages of the present invention will become more apparent upon reviewing the detailed description of the toilet bowl security device which includes a stem portion having first and further end portions. A first suction cup member preferably fabricated from a flexible air impervious material is carried by the first end portion of the stem portion and defines a rim having a selected cross-sectional area. A further suction cup member is fabricated from a flexible air impervious material and is carried by the further end portion of the stem portion. This further suction cup member defines a rim having a selected cross-sectional area that is less than the cross-section defined by the rim of the first suction cup member. In this connection, a user can define which surface the device continues to adhere to when it is released since the device will adhere to the surface joined with the device by the suction cup member having the greater face area. In another embodiment of the invention, a refrigerator door security device is provided for preventing small children from independently gaining access into the contents of a refrigerator. This device includes a first suction cup member and a further suction cup member which are selectively joined by means which serve to secure the door in its closed position. To this end, one suction cup member is mounted on the refrigerator cabinet and the further suction cup member is mounted on the refrigerator door. These members are joined by the securing means to maintain the door in its closed position. Preferably, this device is mounted at a height above the floor which is not accessible by a small child, but which can be readily reached by an adult to disengage the securing means.

BRIEF DESCRIPTION OF THE DRAWINGS

The above-mentioned features of the present invention will be more clearly understood from consideration of the following description when read together with the accompanying drawings in which.

BEST MODE FOR CARRYING OUT THE INVENTION

Figure 1:
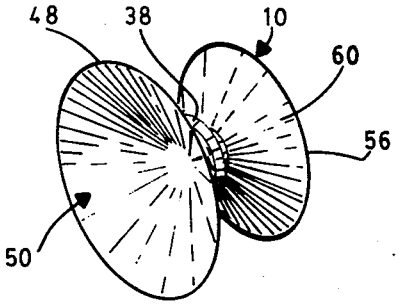
FIG. 1 illustrates a toilet bowl security device constructed in accordance with the various features of the present invention.
Figure 2:
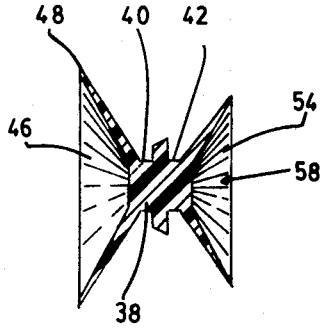
FIG. 2 illustrates a sectional elevation view of the device illustrated in FIG. 1.
Figure 3:
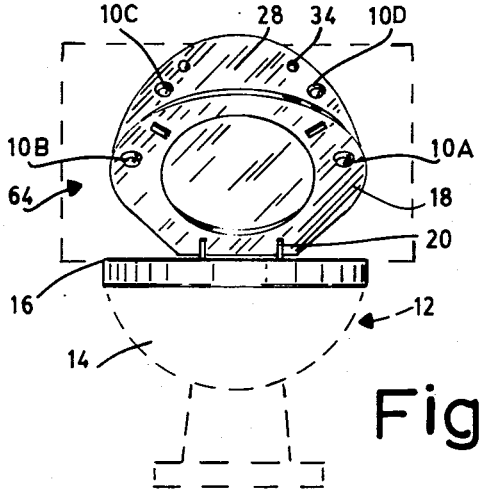
FIG. 3 illustrates a conventional toilet having devices constructed in accordance with the various features of the present invention mounted thereon for purposes of securing the lid and seat of a toilet in the closed position.
Figure 4:
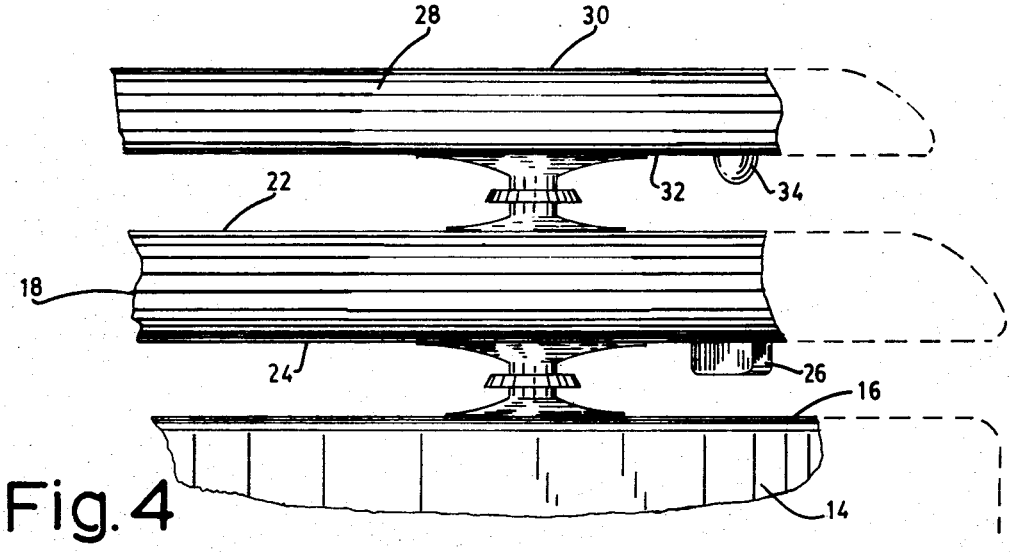
FIG. 4 illustrates one method of mounting the device illustrated in, FIGS. 1 and 2.

Referring now to the drawings, a toilet bowl security device incorporating various features of the invention is generally indicated at 10 in FIG. 1. This device is particularly suitable for maintaining the lid of a toilet bowl in a closed position to prevent a small child from independently gaining access to the water and bowl area of a conventional bathroom toilet. The toilet is generally indicated at 12 and includes a bowl portion 14 terminating in an upper rim 16 which has a flat surface. A pivotal seat portion 18 is secured to the toilet as is well known in the art by means of a suitable hinge 20. This seat portion defines an upper surface 22 contoured to receive the buttocks of a user and a lower surface 24 which carries a suitable stop 26 having a preselected width that rests on the rim 16 of the bowl when the seat portion is deployed for receiving a user. Normally, the stop 26 is fabricated from a suitable resilient and cushioned material which assists in preventing cracking of the seat portion as when the seat portion drops against the bowl. The stop 26 can assume various configurations and a plurality of stops can be mounted at various or spaced locations about the lower surface of the seat portion as shown in FIG. 3.

A lid portion 28 defines an upper surface 30 and a lower surface 32. This lid serves to close the toilet bowl area when the toilet is not in use. In this connection, the cross-sectional outline of the lid approximates the cross-sectional outline of the upper portion of the toilet bowl such that when the lid is deployed to its closed position, the upper portion of the bowl is covered. The lower surface 32 of this lid normally carries a stop 34 having a preselected width which engages the upper surface 22 of the seat portion when the lid portion is deployed. This stop is preferably fabricated from a cushioning material such as hard rubber or plastic and assists in preventing the cracking of the lid portion or the seat portion of the toilet as when the lid portion is inadvertently dropped.

As is well known by adults who keep small children, particularly children who are walking but less than about three years of age, that children enjoy playing in the water normally maintained within the bowl of a toilet. While an effort is generally made to keep bathroom doors closed or place guard rails in the doorways to bathrooms, it is quite common for a child to gain access to a toilet, as when a parent or guardian is distracted by the telephone, front door or for any other reason. The water contained in the toilet bowl is generally unsanitary and can impose a health hazard to a child playing in or splashing the same. Accordingly, the toilet bowl security device of the present invention is designed to assist in preventing a small child from independently gaining access to the water in the bowl area of a conventional bathroom toilet. To this end, the device includes in one embodiment a stem portion 38 which defines first and further end portions 40 and 42, respectively. For reasons which will become more apparent hereinafter, this stem portion defines a length which approximates or is greater than the width of the stop between the surfaces which are to be secured to each other by the device for purposes of maintaining the toilet in a closed condition.

A first suction cup member 46 is mounted on the first end portion 40 of the stem portion 38 of the device. This first suction cup member is preferably fabricated from a flexible air impervious material and defines a rim 48 having a selected cross-sectional area. In the illustrated embodiment, this rim is substantially circular in cross-sectional outline and forms the terminal edge of the face 50 of the first suction cup member. As is known by those familiar with suction cups, depression of the first suction cup member against a flat non-porous surface results in the formation of a vacuum between the surface and the face of the suction cup thereby creating adhesive forces which secure the cup on such surface.

A further suction cup member 54 is mounted on the further end portion 42 of the stem 38, and is fabricated from a flexible air impervious material. This further suction cup member defines a rim 56 which forms the terminal edge of the face 58 of the further suction cup member. In the preferred embodiment, the cross-sectional area of the further suction cup member defined by the rim 56 is less than the crosssectional area defined by the rim of the first suction member. To this end, when each of the suction cup members on the device 10 engage juxtaposed surfaces the further suction cup member will release the surface to which it is secured prior to the release by the first suction cup member to the surface to which it is secured upon the application of separating forces. Accordingly, the devices can be secured such that they will remain on the lower surface of the lid and the lower surface of the seat portion after sufficient force is applied by an adult to force the opening of the lid or the pivotal movement of the seat portion to its upright position for use.

It has been found that utilization of an air impervious polymer enhances the effectiveness of the device. In this connection, the polymer such as a flexible plastic assists in preventing leaking of air into the vacuum area defined between the face of the suction cup and the surface to which it is secured. Accordingly, sponge rubber or the like is not satisfactory as a material for manufacturing the device since it is desirable for the vacuum to be maintained for a substantial period.

As necessary or desired, the suction cup members and the stem can be integrally formed. Moreover, these units can be joined as with a suitable adhesive or glue during the manufacturing operation as is necessary or desired. In one embodiment, the backing portion 60 (see FIG. 1) on the rear portion of the suction cups can be provided with a small stem or stub which is secured to a like stem or stub on the backing of the juxtaposed cup as with an adhesive. This stem or stem portion of the device is preferably proportioned proximate or greater than the effective width of the stop between the surfaces to be secured such that the suction cup members are spaced by distance approximately equal to or greater than the spacing between the surfaces separated by the stop. In this connection, the compressive forces applied when generating the vacuum between the suction cup and the surface to which it is secured can be controlled to enhance the vacuum created during depression of the cup.

A toilet bowl security system incorporating various features of the present invention is indicated generally at 64 in FIG. 3. More specifically, this system includes a plurality of devices 10A-B which are mounted on the lower surface of the seat portion 18. These devices are mounted such that their first suction cup member having the greater face area and accordingly the greater adhesive force is secured to this lower surface 24 of the seat portion. Upon closure of the seat portion or movement to its position of deployment, the further suction cup members engage the rim 16 of the bowl to secure the seat portion to the bowl and thereby prevent a child from lifting the seat portion. Similarly, devices 10C-D are mounted on the lower surface 32 of the lid 28 such that the first suction cup member of these devices 10C-D secures the devices to this surface. This first suction cup members have the greater face area and accordingly the greater adhesive forces are generated between the device and the lower surface of the lid. Upon closure of the lid, that is pivotal movement of the lid until it engages the upper surface of the seat portion 18, the further suction cup members secure the lid and the seat portion together. Thus, upon closure of the lid and the seat portion, the devices create adhesive forces sufficient enough to prevent a small child from opening the upper portion of the toilet bowl yet, these adhesive forces can be readily overcome by an adult desiring to open the lid or raise the seat portion of the toilet.

Figure 8:
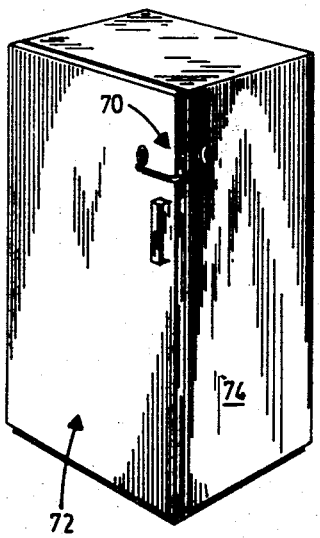
FIGS. 8 and 9 illustrate the refrigerator door security device in a deployed position.
Figure 9:
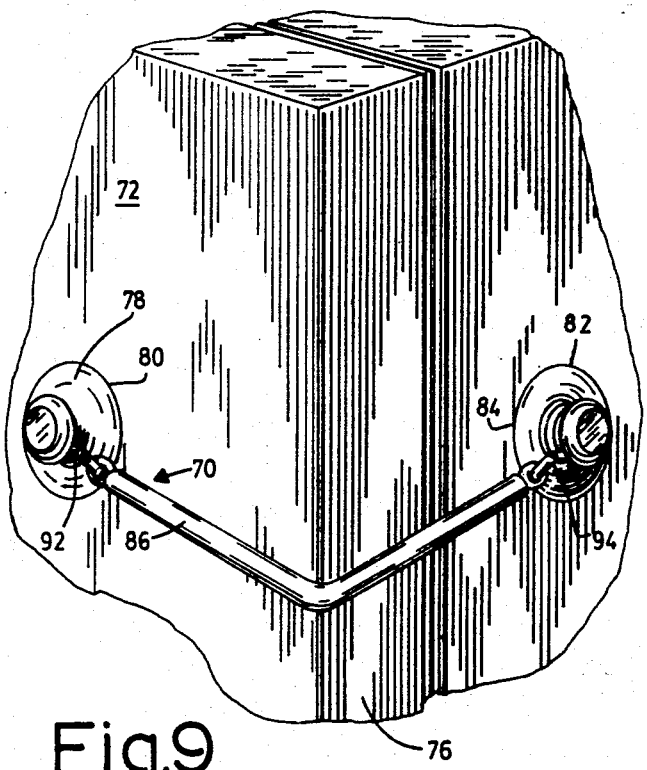

A refrigerator door security device is illustrated generally at 70 in FIG. 8 and FIG. 9. This device is designed for preventing small children from independently gaining access to the contents of a refrigerator having a door 72 pivotally mounted on a cabinet 74 which has a back, side walls, a top and a bottom of conventional design. As shown in FIG. 9, the refrigerator door 72 defines a perimeteral edge 76.

This device 70 includes a first suction cup member 78 fabricated from a flexible air impervious material and defines a rim 80 having a selected cross-sectional area. A cooperating or further suction cup member 82 is mounted on the cabinet 74 of the refrigerator at a preselected location. This suction cup member defines a rim 84 having a selected cross-sectional area. Means 86 are provided for selectively and releasably joining the first suction cup member and the further suction cup member such that the refrigerator door can be secured in its closed position. To this end, the suction cup member 80 is mounted on the door and the cooperating cup member 82 is mounted on the cabinet at a preselected location. The suction cup 82 can be mounted on any section of the cabinet which remains fixed with respect to the door. For example, it could be mounted as necessary or desired on the top of the refrigerator with the only requirement being that the means 86 extends between a stationary section of the cabinet and the door and overlays a crack between the cabinet and the door which must be opened in order to gain access into the refrigerator cabinet.

Figure 5:
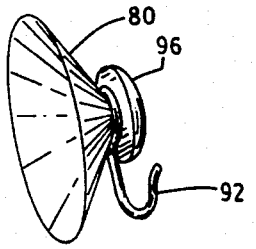
FIGS. 5 and 6 illustrate a suction cup member comprising an integral part of the refrigerator door security device depicted in FIG. 9.
Figure 6:
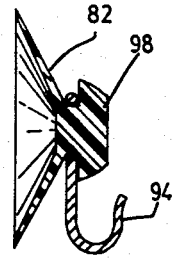
Figure 7:
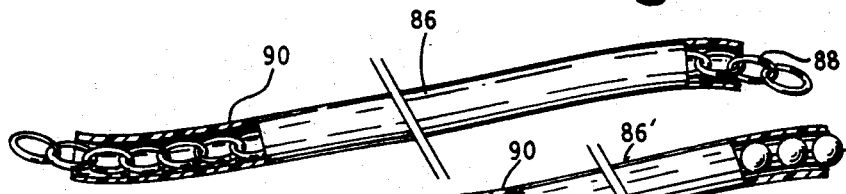
FIG. 7 illustrates one embodiment of means for joining the suction cup members mounted on the door and cabinet of the refrigerator.

In the embodiment illustrated in FIG. 7, the means for selectively and releasably joining the first suction cup member and the further suction cup member comprises a chain 88 having a plastic coating or cover 90 which guards the finish of the refrigerator from the chain links and thereby assists in preventing scarring of the refrigerator. The opposite end portions of the chains are secured to the hook members 92 and 94 on the first and further suction cup members respectively. As shown in FIGS. 5 and 6, these hook members receive the eyelet links at the end portions of the chain 86 and are themselves mounted on the suction cup members 82 and 84 as by bending an end portion of each of the hooks around the stem 96 and 98 of the suction cups 80 and 82, respectively, proximate its flared portion and between the flared portion at the back portion of the suction cup.

Figure 10:
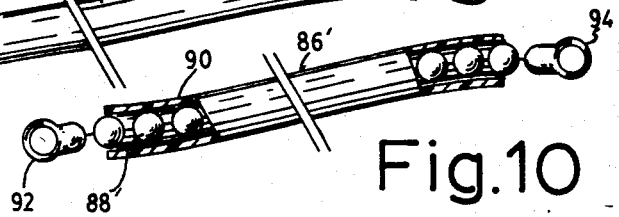
FIG. 10 illustrates a further embodiment of means for selectively joining the suction cup members illustrated in FIG. 9.

FIG. 10 illustrates an alternate embodiment 86' of means for selectively joining and securing the cup members 80 and 82 for preventing a child from independently gaining access into the refrigerator. In this embodiment, a chain 88' is covered with a guard 90' and terminates at its opposite ends in eyelets 92 and 94, respectively, which receive the hooks of the associated suction cup members. Preferably, the device is mounted at a height above the floor which prevents a child from tampering with it, while an adult can readily remove one or both ends of the chain from the hooks to open the door 72.

From the foregoing detailed description, it will be recognized that security devices for protecting the contents of a refrigerator and for securing the lid and seat of a toilet have been described and illustrated. An adult can readily employ and remove the devices in order to gain the desired access. The devices are inexpensive to manufacture and apply restraining forces to the members to be connected sufficient to prevent a small child from gaining access into the contents of a refrigerator or the bowl of a toilet while an adult can readily overcome the forces.

Although the invention has been described in terms of an illustrated preferred embodiments, many of the variations and modifications therein will be apparent to those skilled in the art. Accordingly, this invention is intended to cover all such various and modifications which fall within the spirit and scope of the appended claims.

I claim:

1. A toilet bowl security system including at least a first and further device for preventing small children from independently gaining access to the water and bowl area of a conventional bathroom toilet which has a pivotal seat portion defining an upper surface and a lower surface, said lower surface carrying stop means which rest on the upper rim of the toilet bowl when deployed and a pivotal lid portion which defines an upper surface and a lower surface which carries suitable stop means which rest on the upper surface of the seat portion when the lid is moved to its deployed position for covering the opening in the toilet bowl, each of said devices comprising:

a stem portion defining first and further end portions;

a first suction cup member fabricated from a flexible air impervious material and carried by said first end portion of said stem portion, said first suction cup member defining a rim having a selected cross-sectional area; and a further suction cup member fabricated from a flexible air impervious material and carried by said further end portion of said stem portion, said further suction cup member having a rim defining a crosssectional area which is less than the cross-sectional area defined by said rim of said first suction cup member, whereby one of said devices is mounted such that its first suction cup member engages the upper surface of said bowl rim and its further suction cup member engages the lower surface of said seat portion, and the further device is mounted such that its first suction cup member engages the lower surface of said lid and its further suction cup member engages the upper surface of said seat portion thereby said first suction cup members remain secured to the upper rim of said toilet bowl and the lower surface of said lid inasmuch as the adhesive force of said first suction cup members is greater than the adhesive force of said further suction cup members thereby causing said further suction cup members to separate from the respective surface to which they are joined prior to the separation of said first suction cup members from the respective surfaces to which they are joined.

* * * * *